US007345441B2

(12) United States Patent
Yoshimatsu

(10) Patent No.: US 7,345,441 B2
(45) Date of Patent: Mar. 18, 2008

(54) ROTATION-TYPE WORKING MACHINE

(75) Inventor: Hideaki Yoshimatsu, Kobe (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 10/594,332

(22) PCT Filed: Apr. 4, 2005

(86) PCT No.: PCT/JP2005/006612

§ 371 (c)(1),
(2), (4) Date: Sep. 27, 2006

(87) PCT Pub. No.: WO2005/098147

PCT Pub. Date: Oct. 20, 2005

(65) Prior Publication Data

US 2007/0186451 A1 Aug. 16, 2007

(30) Foreign Application Priority Data

Apr. 7, 2004 (JP) ..... 2004-112805

(51) Int. Cl.
*H02K 7/10* (2006.01)

(52) U.S. Cl. ..... 318/372; 31/362; 31/364; 31/370

(58) Field of Classification Search ..... 318/372, 318/362, 364, 370
See application file for complete search history.

(56) References Cited

U.S. PATENT DOCUMENTS

| | | | | |
|---|---|---|---|---|
| 6,199,307 | B1 * | 3/2001 | Kagoshima et al. | 37/443 |
| 6,424,799 | B1 * | 7/2002 | Gilmore | 388/811 |
| 6,700,341 | B2 * | 3/2004 | Schaer et al. | 318/432 |
| 6,725,581 | B2 * | 4/2004 | Naruse et al. | 37/348 |
| 6,836,614 | B2 * | 12/2004 | Gilmore | 388/811 |
| 6,851,207 | B2 * | 2/2005 | Yoshimatsu | 37/348 |
| 7,067,999 | B2 * | 6/2006 | Sugano et al. | 318/372 |
| 2007/0096670 | A1 * | 5/2007 | Hashimoto et al. | 318/369 |

FOREIGN PATENT DOCUMENTS

| | | |
|---|---|---|
| JP | 11 093210 | 4/1999 |
| JP | 2001 011897 | 1/2001 |
| JP | 2003 184808 | 7/2003 |
| JP | 2004 36304 | 2/2004 |

* cited by examiner

*Primary Examiner*—Lincoln Donovan
*Assistant Examiner*—Michael Brandt
(74) *Attorney, Agent, or Firm*—Oblon, Spivak, McClelland, Maier & Neustadt, P.C.

(57) ABSTRACT

A parking brake is released by a controller and a rotating electric motor is speed-feedback-controlled or position-feedback-controlled to stop and hold an upper rotating body if at least one of arm operation, bucket operation, and travel operation is carried out in a rotating stopped state and with respect to the arm operation and the bucket operation, cylinder thrust of an arm cylinder or a bucket cylinder is greater or equal to a set value. Thereby, a parking brake and a rotating driving part can be prevented from being damaged by rotating external force generated by excavation reaction force or the like and a rotating body can be stopped and held.

7 Claims, 10 Drawing Sheets

ROTATION-TYPE WORKING MACHINE

TECHNICAL FIELD

The present invention relates to a rotating type working machine which drives and rotates a rotating body by an electric motor.

BACKGROUND ART

In rotating type working machines such as a shovel or a crane, as described in the patent literature 1, electric motor driving systems for controlling a rotating direction and a rotating speed by using an electric motor as a rotating driving source and by changing rotation directions and speeds of the electric motor have been known.

According to the electric motor driving systems, energy efficiency can be improved as compared to hydraulic motor driving systems.

Further, in the electric motor driving systems, as described in the patent literature 2, a technique in which a parking brake is operated in a state that rotating operation is stopped, and a rotating body is stopped and held has been known.

In the working machines equipped with a parking brake, external force (hereinafter, referred to as rotating external force) can be generated to the rotating body in a direction of rotating by excavation reaction force due to, for example, excavation by a working device (boom, arm, bucket) of a shovel.

In this case, if the parking brake is working, excessive force can act on the parking brake and a rotating driving part (rotating electric motor, deceleration mechanism) by the rotating external force and the parking brake and the rotating driving part can be damaged.

On the other hand, for a device which employs a hydraulic motor driving system which uses a hydraulic motor as a driving source, as described in the patent literature 3, a technique of releasing a parking brake when a working device is operated has been proposed. This thought can be applied to the devices of electric motor driving system, it is possible to protect a parking brake and a rotating driving part by letting rotating external force loose by releasing the parking brake.

Patent Document 1: Japanese Unexamined Patent Application Publication No. 11-93210

Patent Document 2: Japanese Unexamined Patent Application Publication No. 2001-11897

Patent Document 3: Japanese Unexamined Patent Application Publication No. 2003-184808

DISCLOSURE OF INVENTION

However, if the parking brake is released only under the condition of the operation of the working device, even if excavation reaction force does not act, for example, when the working device is operated in the air or even if only small excavation reaction force acts, the parking brake is uniformly released.

In this state, in the case of the electric motor driving system, electric current is not supplied to the electric motor and output torque is not generated, and therefore, breaking force does not act at all.

Accordingly, there are problems that the rotating body freely moves when the working device is operated on a slope or the rotating body moves by small excavation reaction force and the operation efficiency is decreased.

Further, there are problems in the known arts as described below.

(i) Once the parking brake is released, it is not possible to control the rotating body. Accordingly, for example, when a linear wall surface is excavated or shaped when trenching, the rotating body freely moves by the rotating component force of the excavation reaction force and the operation efficiency is reduced.

(ii) If a road surface slopes or on an uneven road, when traveling, rotating external force is generated due to inertial force which acts on an upper rotating body or the working device. In this case, if the parking brake is not released, excessive reaction force acts and if the parking brake is released, the rotating body freely rotates.

Therefore, the present invention provides a rotating type working machine capable of releasing the parking brake even if the working device is operated, only the case in which the rotating external force which can actually damage the parking brake and the rotating driving part acts.

Further, the present invention provides a rotating type working machine capable of controlling the movement of the rotating body in a brake released state in the case in which the system that the parking brake is released if operation of the working device or traveling operation is carried out is employed.

To solve the above-described problems, the present invention employs a configuration below.

That is, a rotating type working machine includes a lower traveling body; an upper rotating body rotatably mounted on the lower traveling body; a working device attached to the upper rotating body; a rotating electric motor which drives and rotates the upper rotating body; rotating operation means for instructing rotating operation of the upper rotating body; working operation means for instructing working operation of the working device; a parking brake for stopping and holding the upper rotating body; and control means for controlling operation of the parking brake. The control means, when the working operation means is operated, in a state that the rotating operation means is not operated, and if output of the working device based on the operation of the working operation means is greater or equal to a set value, is adapted to release the operation of the parking brake.

Further, a rotating type working machine includes a lower traveling body; an upper rotating body rotatably mounted on the lower traveling body; a working device attached to the upper rotating body; a rotating electric motor which drives and rotates the upper rotating body; each operation means for traveling, rotating, and working for instructing traveling operation of the lower traveling body, rotating operation of the upper rotating body, and working operation of the working device respectively; a parking brake for stopping and holding the upper rotating body; and control means for controlling operation of the parking brake. The control means is adapted to release the operation of the parking brake and to control the rotating electric motor to hold the upper rotating body in a stopped state if operation of at least one of working and traveling operation means is carried out in a state that the rotating operation means is not operated.

According to the present invention, only in the case in which output of the working device is greater or equal to a set value, the parking brake is released.

Accordingly, while the parking brake and the rotating driving part are in no danger of being damaged by excavation reaction force (rotating external force), for example, the working device is moved in the air, if the rotating force is small and the parking brake and the rotating driving part are in no danger of being damaged, by setting a set value so that the parking brake is not released, problems that the rotating body freely rotates on a slope or working efficiency is decreased because it is not possible to countervail against a small excavation reaction force can be reduced.

Further, according to the present invention, while a parking brake is released at the time of operation or traveling operation, electric motor control (speed feedback control or position feedback control) for stopping and holding the upper rotating body is carried out. Accordingly, as described above, while the damage of the parking brake or the like due to the rotating external force is prevented, as an additional feature, the rotating electric motor can countervail against the rotating external force.

Accordingly, operation efficiency can be increased by receiving excavation reaction force when excavating or unexpected rotating of the upper rotating body due to a sloping or uneven road surface.

BEST MODE FOR CARRYING OUT THE INVENTION

Figure 1:
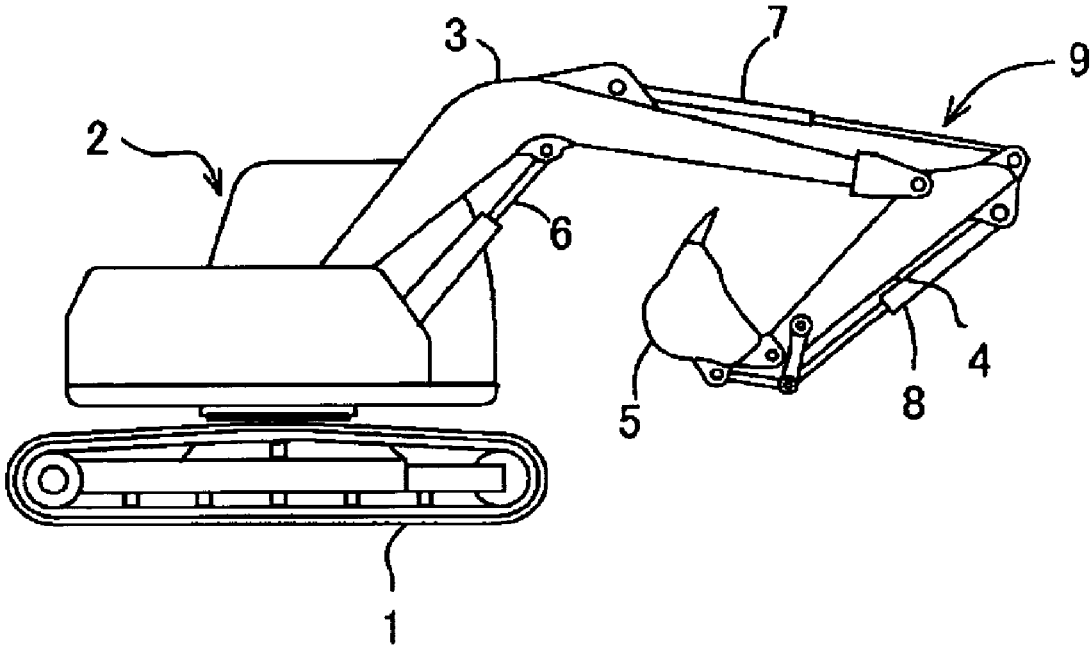
FIG. 1 is a schematic side view of a shovel to which the present invention is applied.
Figure 2:
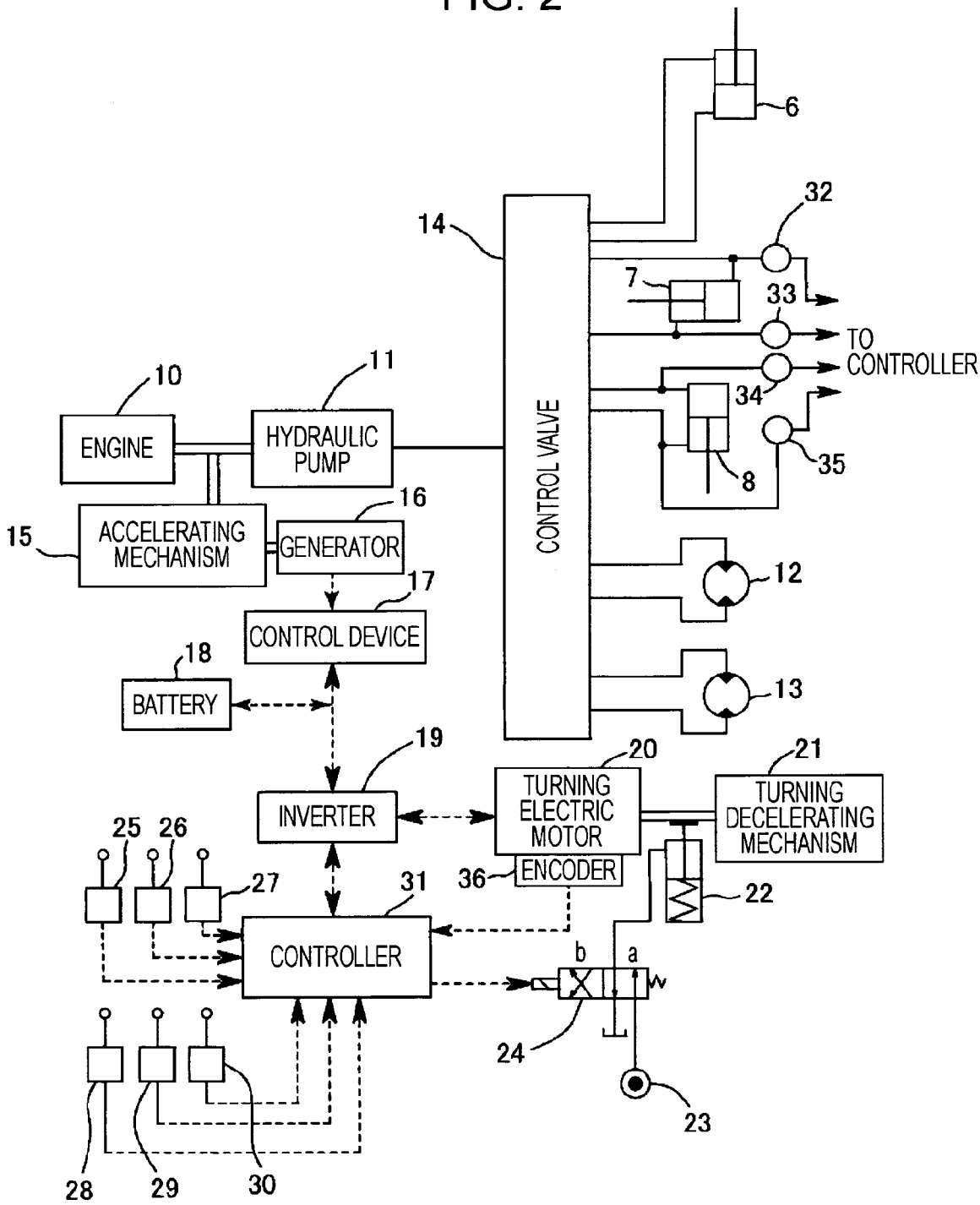
FIG. 2 is a block diagram illustrating a first embodiment of the present invention.
Figure 3:
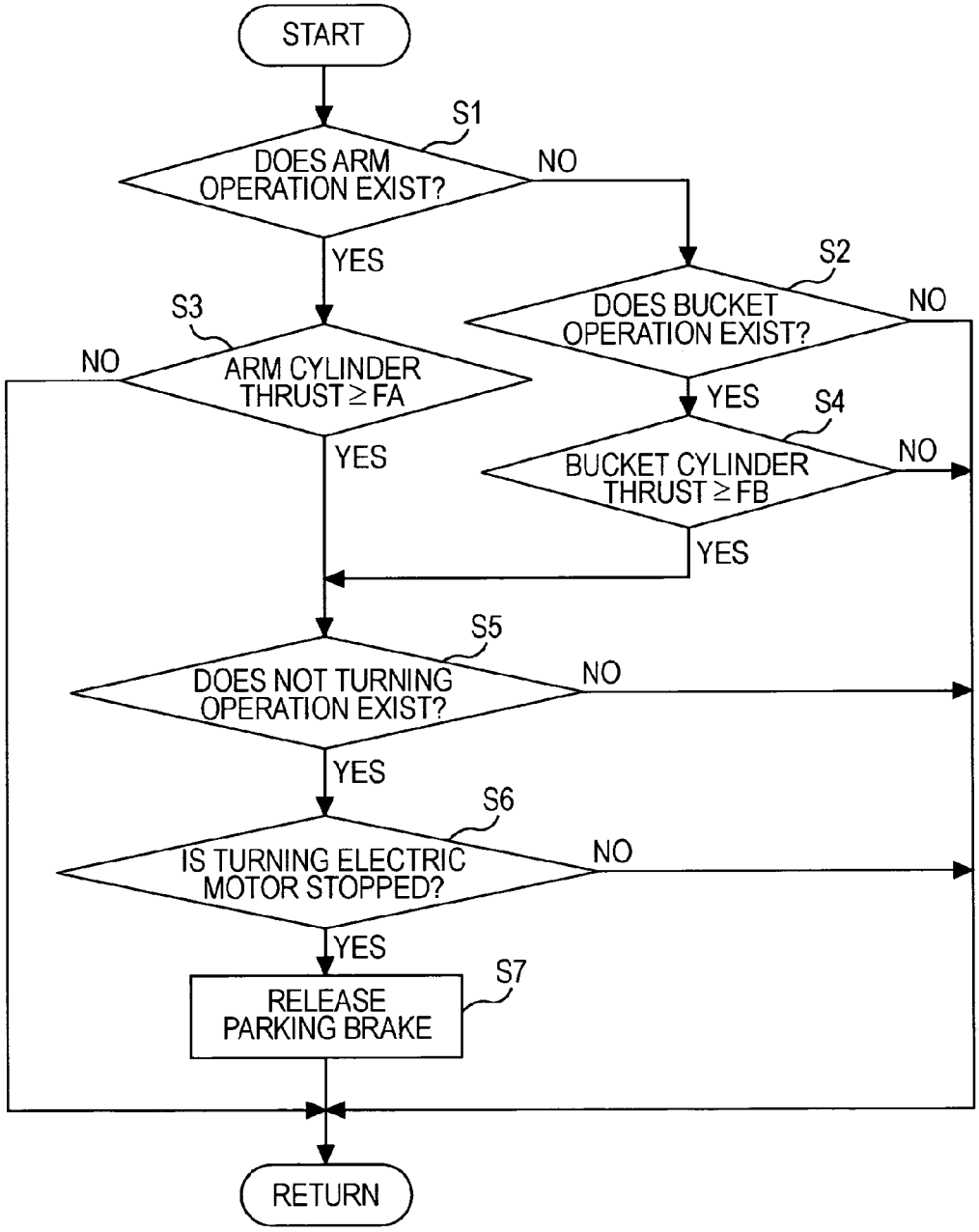
FIG. 3 is a flowchart for explaining process according to the embodiment of the present invention.

First Embodiment (see FIGS. 1 to 3)

FIG. 1 illustrates a shovel to which the present invention is applied.

In the shovel, an upper rotating body 2 is rotatable around a vertical axis and mounted on a crawler type lower traveling body 1. On the upper rotating body 2, a working (excavation) device 9 which has a boom 3, an arm 4, a bucket 5, and cylinders (hydraulic cylinder) 6, 7, and 8 of each of the boom, the arm, and the bucket which drive them, is mounted.

FIG. 2 illustrates a block diagram of an overall driving system and an overall control system of the shovel.

As shown in the drawing, a hydraulic pump 11 is driven by an engine 10 and the discharged oil is supplied to the cylinders 6, 7, and 8 of each of the boom, the arm, and the bucket and right and left traveling motors 12 and 13 which drive the lower traveling body 1 through a control valve 14 (although the valve is provided to each actuator, in this case, it is shown as a valve block).

Further, to the engine 10, a generator 16 is connected through an accelerating mechanism 15, and electric power generated by the generator 16 is supplied to a rotating electric motor 20 through an inverter 19 while charged in a battery 18 through a control device 17 which controls voltage and electric current.

Thus, the rotating electric motor 20 rotates, the rotating force is transmitted to the upper rotating body 2 through a rotating decelerating mechanism 21 and the rotating body 2 rotates leftward or rightward.

The rotating electric motor 20 is, in rotating acceleration, inverter controlled and carries out electric motor work by at least one of electric power of the generator 16 and the battery 18, and in rotating deceleration, inverter controlled and carries out generator work, and charges the electric power generated by the regenerative power generation in the battery 18.

To the rotating electric motor 20, a parking brake (mechanical brake) 22 which generates mechanical braking force is provided.

The parking brake 22 is configured as a hydraulic type negative brake. That is, if an electromagnetic switching valve 24 is switched to a switch position b by an instruction from a controller 31, the braking force is released if hydraulic pressure is introduced to the parking brake 22 from a brake hydraulic pressure source 23 through the electromagnetic switching valve 24, and rotating operation is carried out in this state. Further, if the electromagnetic switching valve 24 is switched to a switch position a, hydraulic pressure of a rod side of the barking brake 22 is discharged to a tank T, and the mechanical braking force by the parking brake 22 is generated.

On the other hand, as operation means, to each actuator of the cylinders 6, to 8 of each of the boom, the arm, and the bucket, the right and left traveling motors 12 and 13, and an actuator of the rotating electric motor 20, a lever type operation parts (for example, a potentiometers) 25 to 30 are provided. Hereinafter, as occasion arises, they are referred to as a boom operation part, an arm operation part, a bucket operation part, a left traveling operation part, a right traveling operation part, and a rotating operation part. Further these operations are referred to as a boom operation, an arm operation, a bucket operation, a left traveling operation, a right operation, and a rotating operation.

Operation signals (signals of not operated are included) from each of the operation parts 25 to 30 are transmitted to the controller 31 which constitutes control means with the inverter 19, according to operation signals other than rotating operation signals, working instruction signals corresponding to each operation direction and operation amount are output from the controller 31 to the control valve 14. Thus, the workings of the cylinders 6, 7, and 8 of each of the boom, the arm, and right and left traveling motors 12 and 13 are controlled according to the operations.

Further, according to the rotating operation signal, an instruction is issued from the controller 31 to the inverter 19, and according to the instruction, acceleration/deceleration control of the rotating electric motor 20 is carried out.

Further, in the machine, pressure sensors 32 to 35 which detect both pressures of the head side and the rod side of the both cylinders 7 and 8 of the arm, and the bucket are provided, and pressure signals from the pressure sensors 32 to 35 are sent to the controller 31.

The controller 31 calculates cylinder thrust generated in both cylinders 7 and 8 of the arm and the bucket with head side received pressure area×head side pressure−rod side received pressure area×rod side pressure.

Further, as means for detecting a rotating position of the rotating electric motor 20 and sending to the controller 31, an encoder 36 is provided.

The encoder 36, for example, detects a relative position (angle) of a stator and a rotor in the rotating electric motor 20, and in the controller 31, whether in a rotating stop state or not is determined based on the detection signal. The encoder signal, as described in descriptions of after a second embodiment, can be used as a rotating position signal of the upper rotating body 2 in a rotating stop state. Further, from the position signal, electric motor speed can be calculated.

The controller 31, based on each of the above signals, a) No rotating operation exists b) In a rotating stop state c) At least one of the both operations of the arm and bucket exists d) Cylinder thrust is greater or equal to a set value (for example, 50% of a maximum thrust determined by a relief valve pressure (not shown))

outputs an instruction signal for relieving a parking brake to the electromagnetic switching valve 24 under the conditions described above.

The process is described with reference to a flowchart in FIG. 3.

At the start of a control, at step S1, it is determined whether an arm operation exits or not, in a case of NO, further at step S2, it is determined whether a bucket operation exists or not. In a case of NO at this step, the process moves to return since control is not necessary.

In a case of YES at step S1, whether arm cylinder thrust is, and in a case of YES at step S2, whether bucket cylinder thrust is grater or equal to set values FA and FB or not are determined respectively (steps S3 and S4), in a case of NO, the process moves to return and in a case of YES, the process moves to step S5.

At step S5, whether a rotating operation does not exist or not and at the next step S6, whether the rotating electric motor 20 is in a stopped state or not are determined respectively. Only in a case that both steps are YES, at step S7, the parking brake 22 is released (in a case of NO, the process moves to return).

As described above, when the rotating operation is not carried out and the work operation (at least one of the arm operation and the bucket operation) is carried out in the state that the rotating electric motor 20 is stopped, and further the output due to the operation is greater or equal to the set value, the parking brake 22 is released.

Accordingly, it can be ensured to prevent the parking brake 22 and the rotating driving part (the rotating electric motor 20 and the rotating decelerating mechanism 21) from being damaged by rotating external force due to excavation.

Further, as well as the case that the working device is moved in the air during working operation, in a case of small rotating force which does not damage the parking brake 22 and the rotating driving part, the set value is determined so that the parking brake 22 is not released, and therefore, the problem that the upper rotating body 2 freely moves on a slope or working efficiency is decreased because it is not possible to countervail against a small excavation reaction force can be reduced.

When excavating, usually, pressure to the rod sides of both cylinders 7 and 8 of the arm and the bucket does not generated. Accordingly, only head side pressure is detected by the sensors 32 and 34 and based on the result, cylinder thrust can be calculated.

Figure 4:
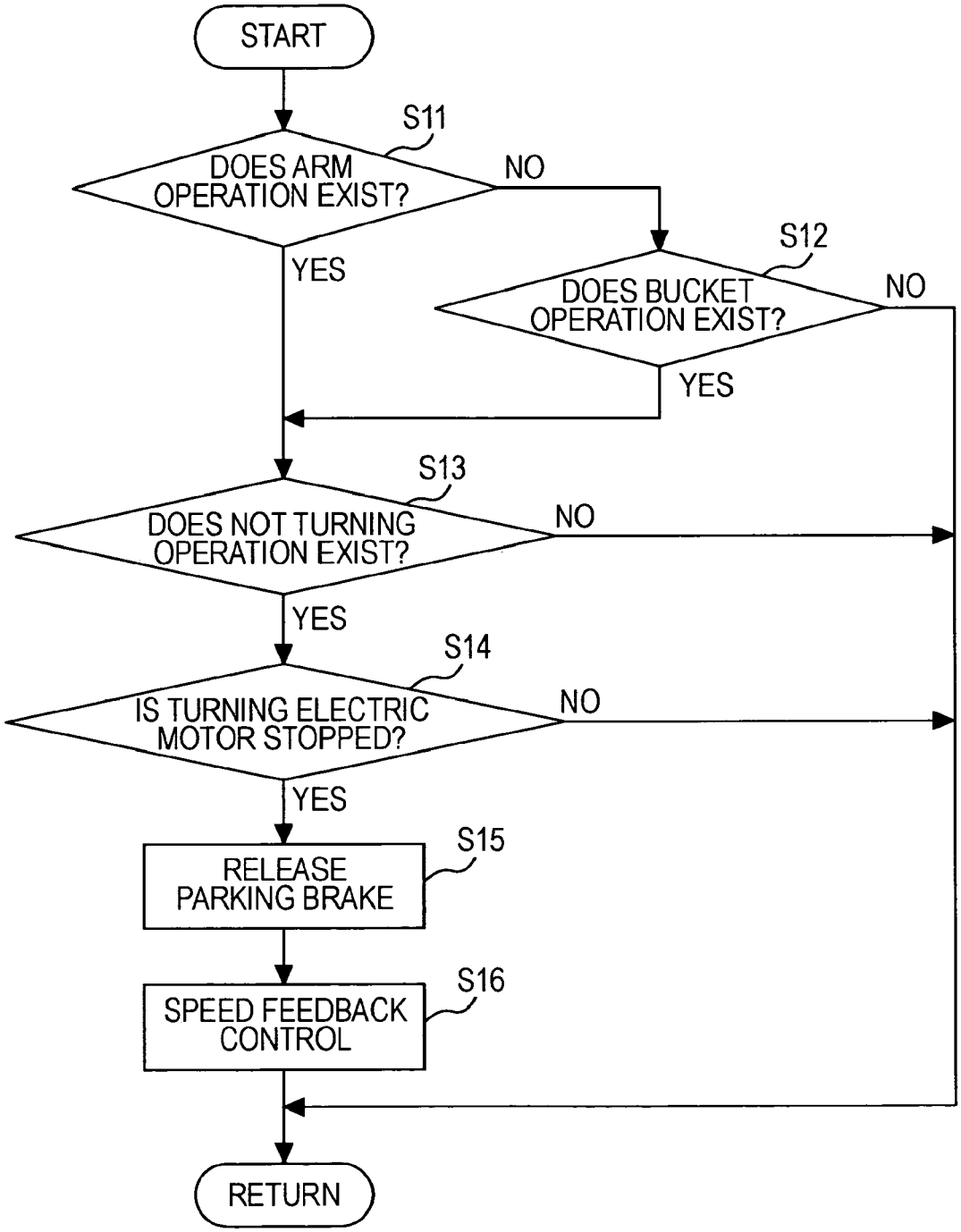
FIG. 4 is a flowchart for explaining process according to a second embodiment of the present invention.
Figure 5:
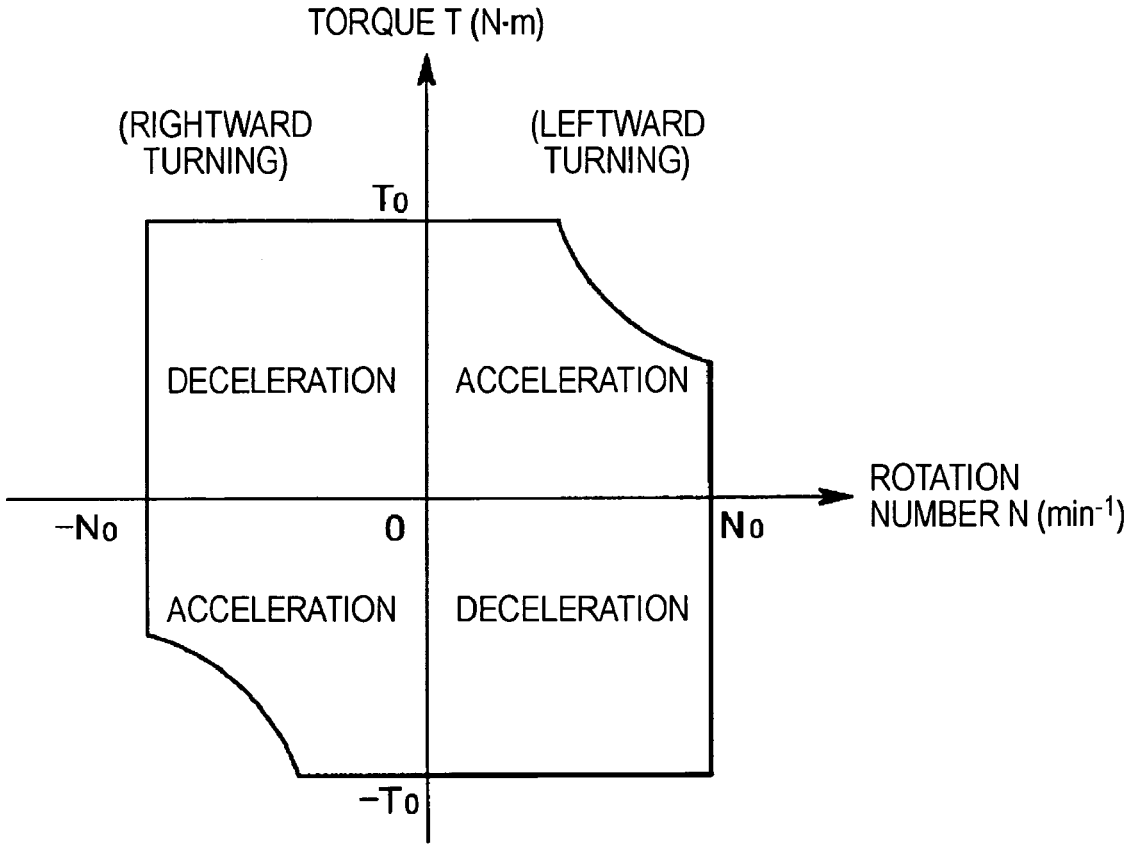
FIG. 5 is a view for explaining a relationship between the number of rotations of a rotating electric motor and torque according to the embodiment of the present invention.

Second Embodiment (see FIGS. 4 and 5)

In each embodiment below, only deference from the first embodiment is described.

In the first embodiment, the main purpose is to protect the parking brake 22 and the rotating driving part when at least one of the arm operation and the bucket operation is carried out by carrying out only the release of the parking brake 22. On the other hand, in the second and other embodiments, while releasing the parking brake 22, the rotating electric motor 20 is controlled in a direction holding the upper rotating body 2 in a stopped state.

Further, in each of the second to fifth embodiments, since the configurations of the hardware themselves are similar to those in the first embodiment and only control contents differ, the configuration of the hardware shown in FIG. 2 is used and only the control contents are described.

In the second embodiment, as shown in FIG. 4, whether an arm operation exists or not is determined at step S11 and whether a bucket operation exists or not is determined at step S12 respectively. If either step is YES, further, whether a rotating operation exists or not is determined at step S3 and whether the rotating electric motor 20 is stopped or not is determined at step S4.

In a case of YES at both steps, at step S15, the parking brake 22 is released.

Further, at step S16, a speed feedback control of the rotating electric motor 20, that is, a feedback control is carried out by a deviation between a target speed (0) and an actual speed based on a position signal from the encoder 36 so that an electric motor speed (actual speed) calculated in the controller 31 is to be 0.

In this control method, even if the rotating electric motor 20 is moved by external force generated when rotating external force generated by an arm operation or a bucket operation is larger than electric motor torque, the rotating electric motor 20 is controlled so that the speed is always to be 0 at the moved part.

By the electric motor control, the rotating electric motor 20 can perform reaction force against the rotating external force. Accordingly, when excavating, excavation reaction force is balanced and working efficiency can be increased, or when traveling, unexpected rotating of the upper rotating body 2 due to slope or unevenness of a load surface can be prevented.

Further, by the speed feedback control, since control force by the rotating electric motor 20 against the rotating reaction force works, working efficiency, for example, when excavating a groove in a target direction, can be improved.

When the electric motor control is carried out, it is preferred that the maximum torque of the rotating electric motor 20 is limited to less or equal to the maximum value of rotating driving torque.

FIG. 5 illustrates relationship between the number of rotations N and torque T of the rotating electric motor 20 at the time of rotating acceleration and deceleration. In the drawing, if the number of rotations N is in the positive area, it denotes leftward rotating and if the number of rotations N is in the negative area, it denotes rightward rotating. The first and third quadrants show the relationship between the number of rotations N and torque T at the time of rotating acceleration by electric motor torque and the second and fourth quadrants show the relationship between the number of rotations N and torque T at the time of rotating deceleration by the electric motor torque respectively.

In the drawing, a characteristic drawn by a bold line shows a case in which the rotating electric motor 20 is controlled at the maximum torque $T_0$, $-T_0$ at the time of rotating, and at the time of rotating driving, the rotating electric motor 20 is controlled within the maximum torque $T_0$, $-T_0$.

In this embodiment, at the time of electric motor control carried out with parking brake release, the maximum torque of the rotating electric motor 20 is also limited to less or equal to the maximum value of the rotating driving torque drawn by the bold line.

Thus, it can be prevented that excessive torque acts on the rotating driving part.

Figure 6:
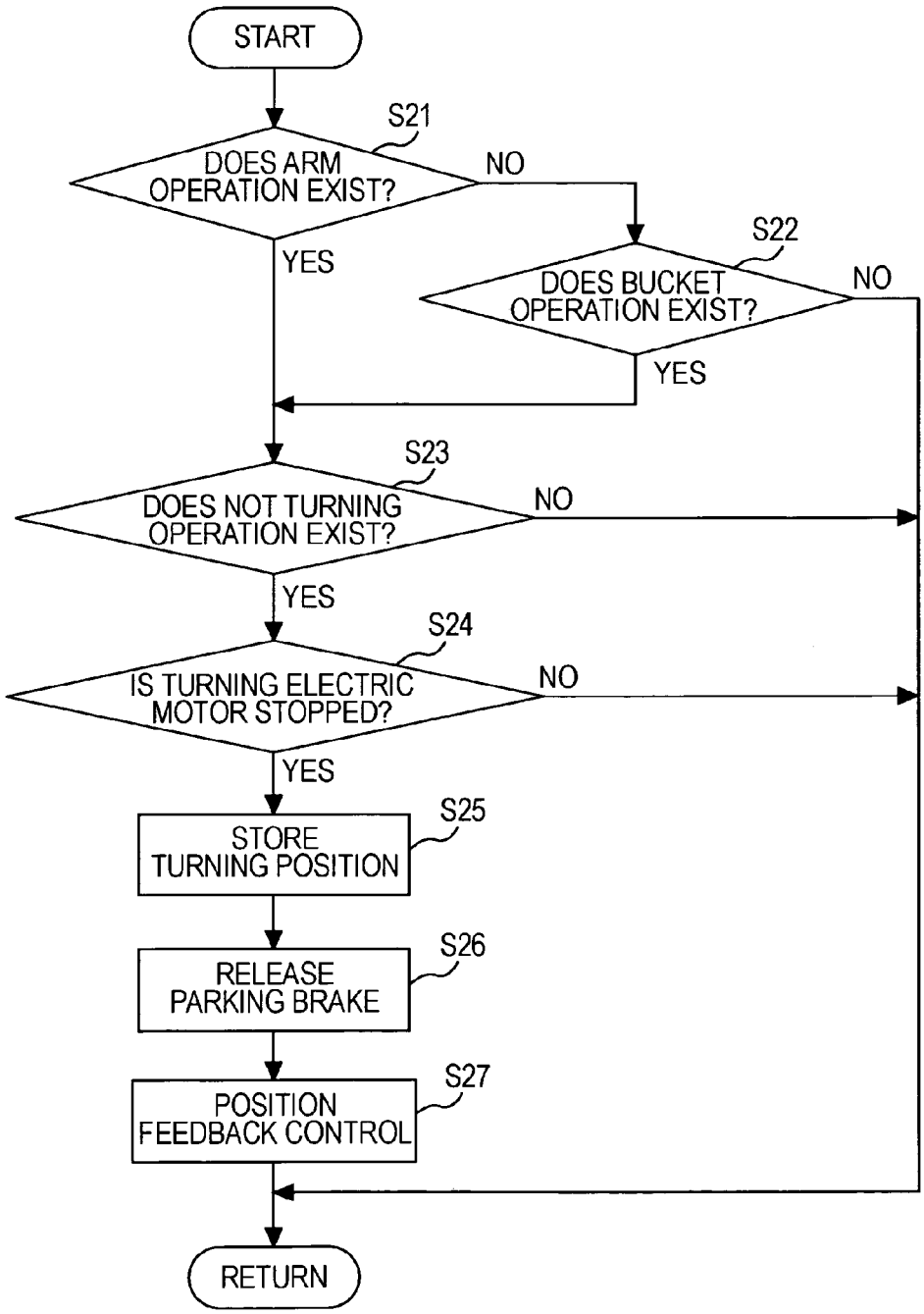
FIG. 6 is a flowchart for explaining process according to a third embodiment of the present invention.

Third Embodiment (see FIG. 6)

In a third embodiment, in place of the speed feedback control described in the second embodiment, a position feedback control is employed.

That is, steps S21 to 24 are similar to those in the steps S11 to S14 in FIG. 4, at step S25, a rotating position of the time is stored and at step S26, the parking brake 22 is released. Then, at step S27, the position feedback control, that is, based on a position signal from the encoder 36, by a deviation of a position at the time of control start and a position detected later, the feedback control is carried out.

In this control method, even if the rotating electric motor 20 moves due to external force if the external force is larger than electric motor torque, if the external force becomes smaller than the electric motor torque, the rotating electric motor 20 is controlled to return to a target position.

According to the position feedback control, as well as the second embodiment, when excavating, excavation reaction force is balanced and working efficiency can be increased, or when traveling, unexpected rotating of the upper rotating body 2 due to slope or unevenness of a load surface can be prevented. In addition, excavation working efficiency at excavation work of a predetermined shape such as a groove excavation can be increased.

Further, when traveling, even if rotating is occurred due to inertial force, it is returned to the original rotating position when the traveling ends.

In the position feedback control, as well as the second embodiment, it is preferred that the maximum torque of the rotating electric motor 20 at the time of electric motor control is limited to less or equal to the maximum value of rotating driving torque.

Figure 7:
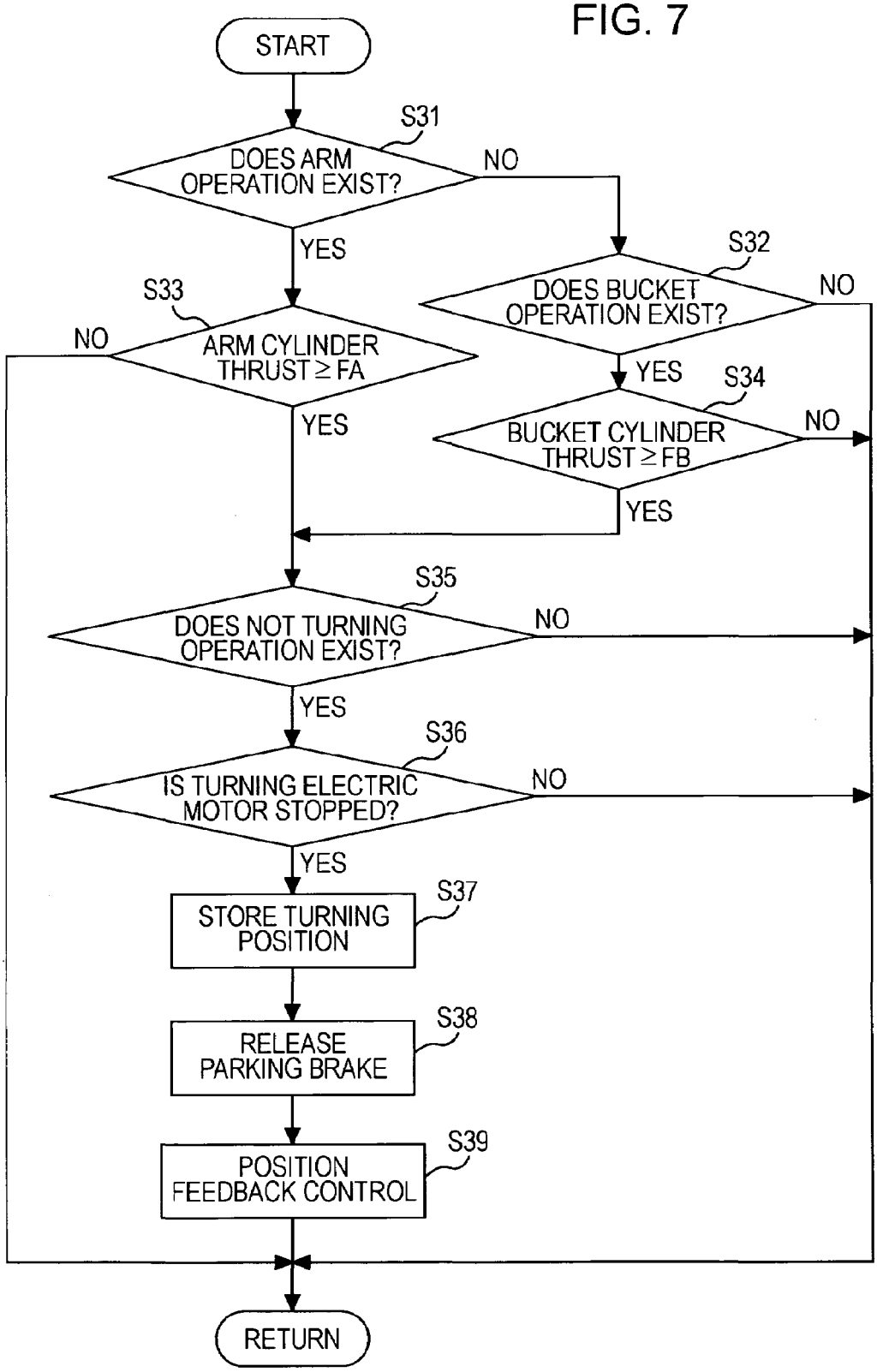
FIG. 7 is a flowchart for explaining process according to a fourth embodiment of the present invention.

Fourth Embodiment (see FIG. 7)

In a fourth embodiment, based on the third embodiment, a condition that cylinder thrust of both cylinders 7 and 8 of the arm and the bucket is greater or equal to a set value, which is employed in the first embodiment, is added to the starting conditions of the parking brake release and electric motor control.

That is, at steps S31 and 32, whether an arm operation and a bucket operation exist or not is determined. If the arm operation exists, at step S33, and if the bucket operation exists, at step S34, cylinder thrust and the set value are compared respectively.

In a case of YES at this step, at step S35, whether a rotating operation does not exist or not, and at step S36, whether the rotating electric motor 20 is stopped or not are determined respectively. In a case of YES at both steps, at steps S37 to 39, a rotating position is stored, the parking brake is released, and a position feedback control of the rotating electric motor 20 are carried out.

Instead of the position feedback control, the speed feedback control in the second embodiment can be employed.

According to the fourth embodiment, in addition to the effects in the third (or the second) embodiment, the effects in the first embodiment can be obtained, that is, in a case of small rotating force which does not damage the parking brake 22 and the rotating driving part, the parking brake 22 is not released, and therefore, the problem that the upper rotating body 2 freely moves on a slope or working efficiency is decreased because it is not possible to countervail against a small excavation reaction force, can be reduced.

Figure 8:
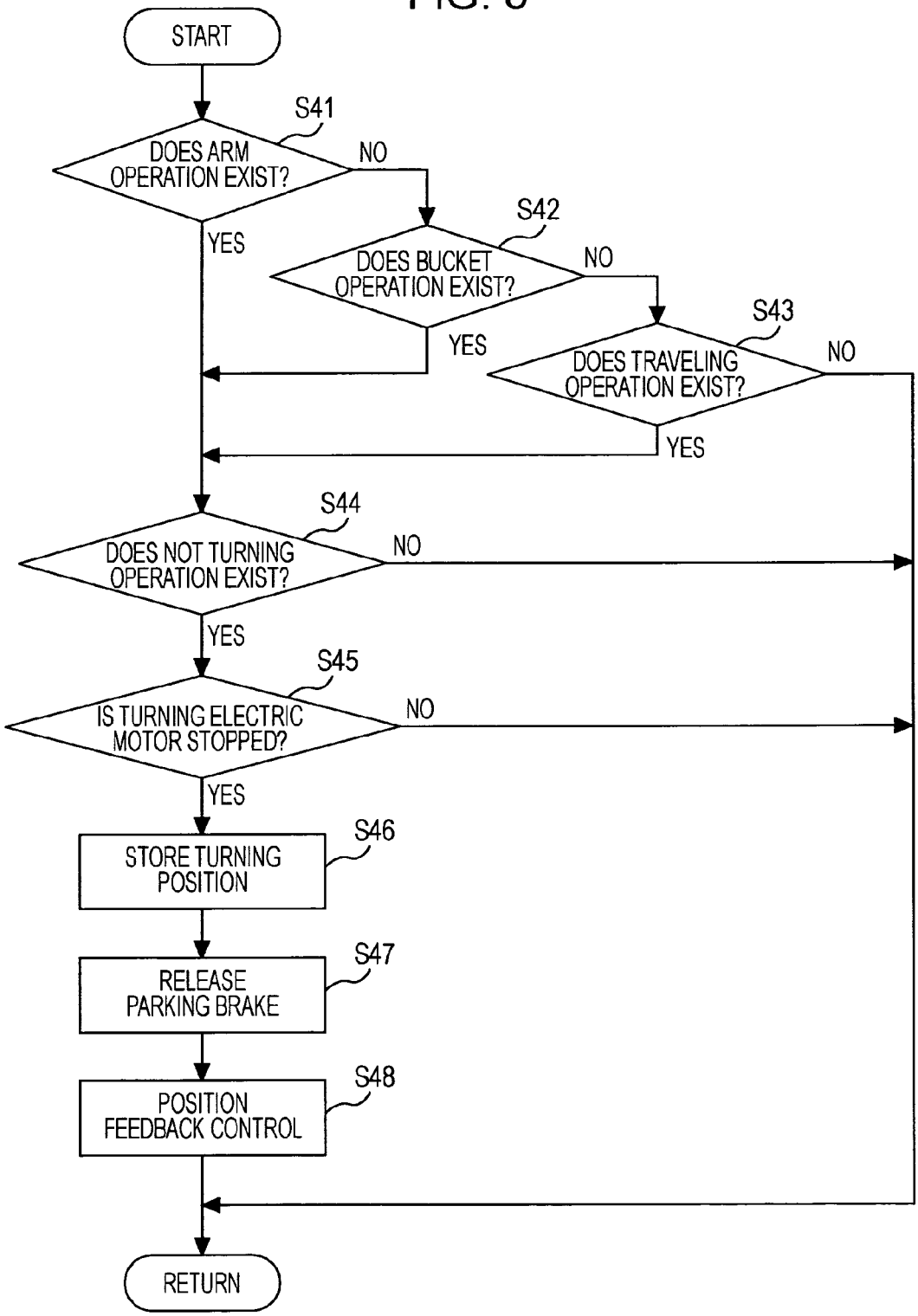
FIG. 8 is a flowchart for explaining process according to a fifth embodiment of the present invention.

Fifth Embodiment (see FIG. 8)

On a slope or uneven-load surface, when traveling, even if an arm operation or a bucket operation is not carried out, rotating external force acts on the upper rotating body 2. Then, excessive torque acts on the parking brake 22 and the rotating driving part and they can be damaged.

Accordingly, in a fifth embodiment, not only the arm operation or the bucket operation, also when a traveling operation is carried out, electric motor control (in this case, position feedback control) for stopping and holding the upper rotating body 2 is carried out while the parking brake 22 is released.

That is, in addition that at step S41, whether an arm operation exists or not and at step S42, a bucket operation exists or not are determined respectively, whether a traveling operation exists or not is determined at step S43 based on operation signals from right and left traveling operation parts 28 and 29.

Among the steps, in a case of YES at some step, a determination whether a rotating operation does not exist or not (step S44) and a determination whether the rotating electric motor 20 is stopped or not (step S45) are carried out. In a case of YES at both steps, a storage of a rotating position (step S46), a release of parking brake 22 (step S47), and a position feedback control (step S48) are carried out respectively.

By the control, also at the time of traveling, effects similar to each of the second to fourth embodiments can be obtained.

Instead of the position feedback control, the speed feedback control can be employed. Further, as well as the fourth embodiment, to the arm operation and the bucket operation, depending on the cylinder thrust as a result, whether to carry out the parking brake release and the electric motor control can be determined.

Figure 9:
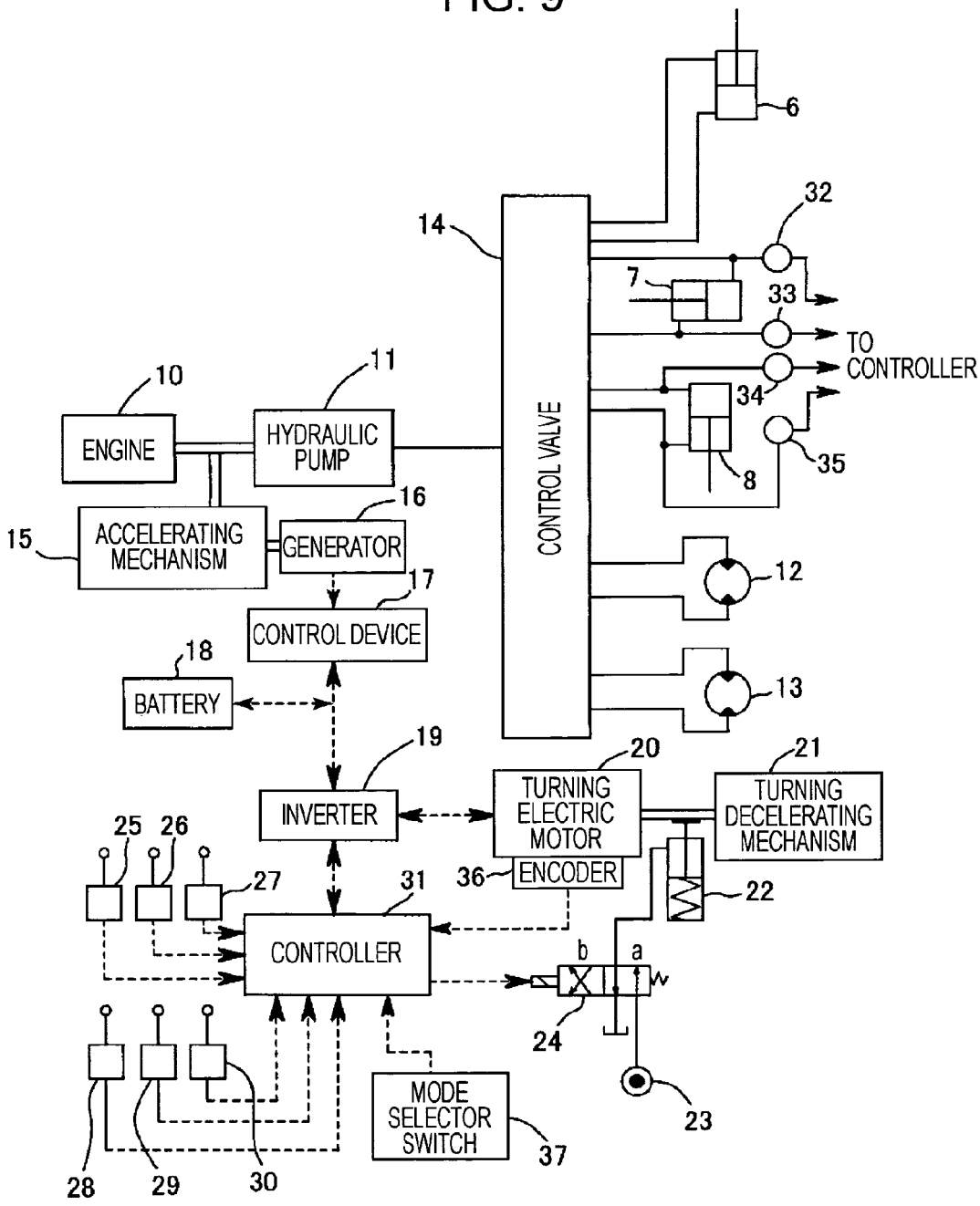
FIG. 9 is a block diagram illustrating a sixth embodiment of the present invention.
Figure 10:
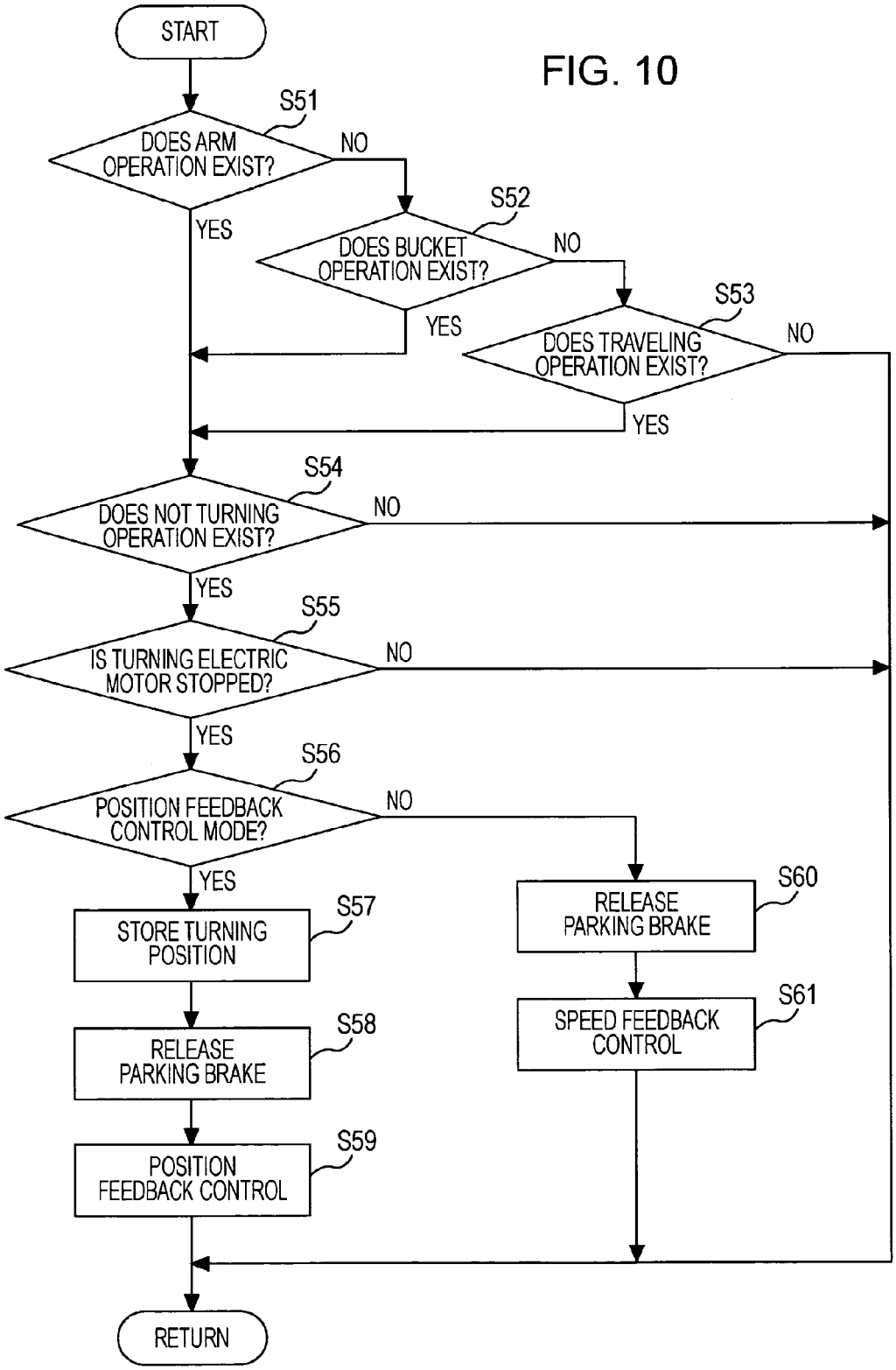
FIG. 10 is a flowchart for explaining process according to the embodiment of the present invention.

Sixth Embodiment (see FIGS. 9 and 10)

In each of the second to fifth embodiments, as the electric motor control carried out at the time of release of the parking brake brake 22, either of the speed feedback control or the position feedback control is determined in advance. On the other hand, in a sixth embodiment, the operator can arbitrarily select an electric motor control mode from both of the control methods.

That is, as shown in FIG. 9, a mode selector switch 37 for switching control modes between the two kinds of modes and instructing the controller 31 is provided, and by the controller 31, electric motor control in the selected mode is carried out.

The contents of the control are described with reference to FIG. 10. This embodiment is based on the fifth embodiment (the traveling operation is also included as conditions for parking brake release and electric motor control) shown in FIG. 8, and steps S51 to 55 are similar to steps S41 to 45 shown in FIG. 8.

At step S56, whether the selected mode is the position feedback control or not is determined. In a case of YES (position feedback control), the rotating position is stored at step S57, the parking brake 22 is released at step S58, and the position feedback control is carried out at step S59.

On the other hand, in a case of No (speed feedback control) at step S56, the parking brake 22 is released at step S60 and the speed feedback control is carried out at step S61.

Thus, since the control mode can be arbitrarily selected and switched between the two control methods; the speed feedback control and the position feedback control, a method suitable for the type of work or preference of the operator can be selected, and therefore, working efficiency and operationality can be increased.

As described above, in the present invention, the parking brake is released only in the case that output of the working device is greater than the set value.

Further, in the present invention, while the parking brake is released at the time of working operation or traveling operation, electric motor control (speed feedback control or position feedback control) for stopping and holding the upper rotating body is carried out.

In this case, according to the invention in claim 3, since the parking brake still works if the rotating force is small and the force does not affect as in the case that the working device is moved in the air, the rotating body does not freely moves on a slope, etc. and unnecessary electric motor control is not carried out.

Further, according to the invention in claim 4, as the electric motor control, the speed feedback control to eliminate a deviation of a target speed (0) and an actual speed is carried out. In this control method, even if the electric motor is moved due to external force if rotating external force becomes greater than electric motor torque, the speed is controlled to be always 0 at the moved part.

Therefore, according to this control method, especially in excavation, control force by the rotating electric motor acts on excavation reaction force in the rotating direction, the working efficiency in the case that a groove is excavated in a target direction is increased.

On the other hand, according to the invention in claim 5, as the electric motor control, the position feedback control which eliminates a deviation of a target position and an actual position is carried out. In this method, even if the electric motor is moved due to external force if the external force is greater than electric motor torque, if the external force becomes smaller than the electric motor torque, it is controlled to return to the target position.

By this control method, efficiency in excavation work of a predetermined shape such as a groove excavation can be increased. Further, even if rotating occurs due to inertial force during traveling, it is returned to the original rotating position when the traveling ends.

According to the invention in claim 6, it is possible to arbitrarily select a control method suitable for work (the speed feedback control mode or the position feedback control mode) between the above two methods and switch to the method.

According to the invention in claim 7, in the above electric motor control, since the maximum torque of the rotating electric motor is limited to less or equal to the maximum value of the rotating driving torque, it is possible to prevent excessive torque from acting on the rotating driving part.

INDUSTRIAL APPLICABILITY

According to the present invention, in a working machine having a parking brake, beneficial effect that only in the case that rotating external force which can damage the parking brake and a rotating driving part actually acts, the parking brake is released, is achieved.

The invention claimed is:

1. A rotating type working machine comprising: a lower traveling body; an upper rotating body rotatably mounted on the lower traveling body; a working device attached to the upper rotating body; a rotating electric motor which drives and rotates the upper rotating body; rotating operation means for instructing rotating operation of the upper rotating body; working operation means for instructing working operation of the working device; a parking brake for stopping and holding the upper rotating body; and control means for controlling operation of the parking brake; wherein the control means, when the working operation means is operated in a state that the rotating operation means is not operated, and if output of the working device based on the operation of the working operation means is greater or equal to a set value, is adapted to release the operation of the parking brake.

2. A rotating type working machine comprising: a lower traveling body; an upper rotating body rotatably mounted on the lower traveling body; a working device attached to the upper rotating body; a rotating electric motor which drives and rotates the upper rotating body; each operation means for traveling, rotating, and working for instructing traveling operation of the lower traveling body, rotating operation of the upper rotating body, and working operation of the working device respectively; a parking brake for stopping and holding the upper rotating body; and control means for controlling operation of the parking brake; wherein the control means is adapted to release the operation of the parking brake and to control the rotating electric motor to hold the upper rotating body in a stopped state if operation of at least one of working and traveling operation means is carried out in a state that the rotating operation means is not operated.

3. The rotating type working machine according to claim 2, wherein, the control means, in addition that the working operation means is operated, if output according to the operation of the working operation means is greater or equal to a set value, is adapted to release the operation of the parking brake and control the electric motor.

4. The rotating type working machine according to claim 2, wherein, the control means, as an electric motor control, is adapted to carry out speed feedback control of the rotating electric motor for controlling rotating speed to be zero.

5. The rotating type working machine according to claim 2, wherein, the control means, as an electric motor control, is adapted to carry out position feedback control of the rotating electric motor for holding a rotating position where the operation of the parking brake is released.

6. The rotating type working machine according to claim 2, further comprising mode switching means, wherein the mode switching means is adapted to switch a mode of the electric motor control by the control means between;

A) a speed feedback control mode for carrying out a speed feedback control of the rotating electric motor so that a rotating speed becomes to zero; or B) a position feedback control mode for carrying out a position feedback control of the rotating electric motor to hold the rotating position where the operation of the parking brake is released.

7. The rotating type working machine according to claim 4, wherein, the control means is adapted to limit a maximum torque of the rotating electric motor at the time of electric motor control to be less or equal to a maximum value of rotating driving torque.

* * * * *